US005339981A

United States Patent [19]

Kral

[11] Patent Number: 5,339,981

[45] Date of Patent: Aug. 23, 1994

[54] PAINT CAN SEALER

[76] Inventor: Dean C. Kral, 419 Pentilly, St. Clair Beach, Ontario, Canada, N8N 4L6

[21] Appl. No.: 12,208

[22] Filed: Feb. 2, 1993

Related U.S. Application Data

[63] Continuation-in-part of Ser. No. 910,965, Jul. 9, 1992, Pat. No. 5,213,230.

[51] Int. Cl.[5] ..... B65D 81/24; B65D 51/16

[52] U.S. Cl. ..... 220/580; 220/227; 220/231; 220/287; 220/361; 220/367; 220/578; 220/764; 220/770

[58] Field of Search ..... 220/216, 221, 227, 231, 220/284, 287, 361, 367, 375, 380, 578, 580, 759, 764, 770

[56] References Cited

U.S. PATENT DOCUMENTS

| | | | |
|---|---|---|---|
| 1,815,569 | 7/1931 | Johnson | 220/580 X |
| 2,828,886 | 4/1958 | Thomas | 220/580 X |
| 3,164,289 | 1/1965 | Cocchiarella | 220/578 |
| 3,924,774 | 12/1975 | Donnelly | 220/580 |
| 3,949,897 | 4/1976 | Shaw et al. | 220/231 |
| 4,625,883 | 12/1986 | Burke et al. | 220/578 |
| 4,723,674 | 2/1988 | Nunes | 220/227 X |
| 4,905,863 | 3/1990 | Blomquist et al. | 220/367 |
| 4,907,719 | 3/1990 | Spotholz et al. | 220/216 X |
| 4,938,377 | 7/1990 | Jarvis | 220/216 |
| 5,213,230 | 5/1993 | Kral | 220/580 |

*Primary Examiner*—Allan N. Shoap
*Assistant Examiner*—Vanessa Caretto
*Attorney, Agent, or Firm*—Jeffrey T. Imai; Arne I. Fors; D. Doak Horne

[57] ABSTRACT

A sealing device for sealing the surface of contents of a container comprises a disc-like member having a central portion and a flexible perimeter and having a centrally located upstanding hollow handle having a purge valve at the upper end thereof. The purge valve has a closed position for preventing egress of air upwardly through said hollow handle and an open position to permit free passage of air therethrough. The disc-like member is contoured to correspond with the shape of the interior plan of the container.

7 Claims, 6 Drawing Sheets

PAINT CAN SEALER

This application is a continuation-in-part application of Ser. No. 07/910,965, filed, Jul. 9, 1992, now U.S. Pat. No. 5,213,230.

FIELD OF INVENTION

The invention relates to a device for providing a seal in a container such that the seal substantially eliminates contact between the contents of the container and the surrounding air regardless of the height to which the container is filled. More particularly, the invention relates to a sealing device which prevents the formation of a skin on the surface of paint stored within a paint can.

BACKGROUND OR INVENTION

It is a common experience among people familiar with painting that after placing the lid back on a partially used paint can and then re-opening it at a later date, a skin has formed on the surface of the stored paint. The removal of the skin is a difficult and messy task which often produces unsatisfactory results.

Often the skin will break-up and leave particles within the can which tend to mar the surface of the item or wall being painted.

The formation of the skin is caused by the reaction between the paint and the surrounding air. Even when a paint can is tightly sealed using the lid provided with the can an amount of air, such amount depending upon the amount of paint that remains in the can, is still trapped within the container. As a result, so long as such air is trapped within the can, an undesirable skin will form.

Previous devices have attempted to solve the above problem by isolating the paint within the can from any surrounding air. Examples of such devices are disclosed in the following U.S. Pat. Nos. 4,682,705; 2,828,886; 2,556,195; 4,625,883; 3,266,662 and 4,874,108.

These previous devices generally suffer from several problems. First, the devices disclosed are generally complex in construction. As a result of such complexity, their production is an expensive undertaking. Secondly, insertion of several of the previously known devices causes an amount of air to be trapped within the can between the sealing device and the contents of the container. Thirdly, such known devices do not permit easy removal from the contents of the container as a suction will be created when attempting to remove such devices from the surface of the contents.

SUMMARY OF INVENTION

The disadvantages of the prior art may be overcome by a sealing device which is inserted within the can and placed directly upon the surface of the paint as well as in sealing engagement with the internal wall of the can thereby substantially eliminating any contact between the paint and the surrounding air. A valve releases the trapped air for full contact of the sealing device with the contents and easy removal therefrom.

It is therefore desirable to provide a sealing device which substantially eliminates all contact between the contents of a container and the surrounding air regardless of the height to which the container is filled.

It is further desirable to provide a sealing device which is simple in design thereby allowing for relatively inexpensive mode of construction, in particular such that the device may be formed by a single injection molding.

It is further desirable to provide a sealing device which contains a centrally located purge valve to release air from being trapped between the device and the contents of the container during insertion of the device.

It is further desirable to provide a sealing device for use within a paint can which substantially eliminates all contact between the air and the paint thereby preventing the formation of a skin on the surface of the paint.

According to one aspect of the invention, there is provided a sealing device for sealing the surface of contents of a container. The device comprises a disc-like member having a central portion and a flexible perimeter and having a centrally located upstanding hollow handle having a purge valve at the upper end thereof. The purge valve has a closed position for preventing egress of air upwardly through said hollow handle and an open position to permit free passage of air therethrough. The disc-like member is contoured to correspond with the shape of the interior plan of the container.

In a further aspect of the invention, when the device is urged towards the surface of the contents of the container air trapped therebetween will escape through the purge valve until said device is in intimate contact with the surface, sealing same. When the device is urged away from the surface and the valve is in an open position air will ingress therebetween permitting free removal of the device from the surface.

In a further aspect of the invention, the interior of the handle is contoured to receive a like handle for storing like devices in a nested condition.

According to still yet another aspect of the invention, there is provided a sealing device for sealing a container having a bottom, an interior plan and a closable top. The container is fillable with a liquid content to present an upper surface. The device comprises a disc-like member having a central portion and a flexible perimeter and a centrally located upstanding hollow handle having a purge valve. The purge valve has a closed position for preventing egress of air through the hollow handle and an open position to permit free passage of air therethrough. The disc-like member is contoured to correspond with the interior plan of the container. The purge valve comprises an aperture in an upper end of the handle, a stopper for slideably inserting through the aperture for moving the purge valve between the open position and the closed position. The stopper has a stem portion having a seal region for sealingly engaging the aperture and having a lip formation for engaging the aperture in a snap fit releasably retaining the seal region in sealing engagement with the aperture when the purge valve is in the closed condition. A tab formation is at a first end of the stem which is biased to permit insertion of the stopper into the aperture and to retain the stopper therein. The tab formation is sized to partially close the aperture when the valve is in the open position. A pull ring is at an end of the stem opposite the tab formation. The pull ring is for gripping the stopper to facilitate pulling of the stopper for moving the purge valve from the closed position to the open position. The pull ring is sized to be placed about the handle and the handle has an interior which is contoured to receive a like handle for storing like devices in a nested condition when the pull ring is placed about the handle. The device is preferably made from a nylon material and injection molded and is contoured to fit within a paint can.

DETAILED DESCRIPTION OF THE DRAWINGS

In the drawings which illustrate the embodiment of the invention:

DETAILED DESCRIPTION OF THE INVENTION

Figure 1:
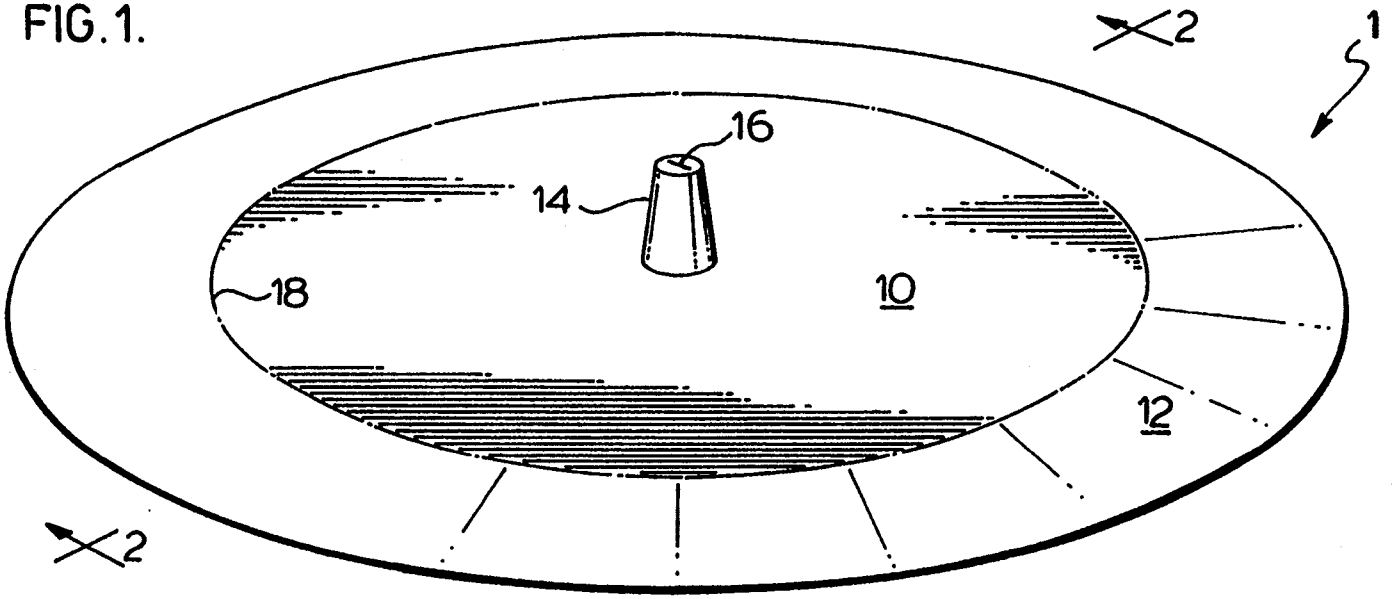
FIG. 1 is a perspective view of the top of the preferred embodiment of the invention.
Figure 2:
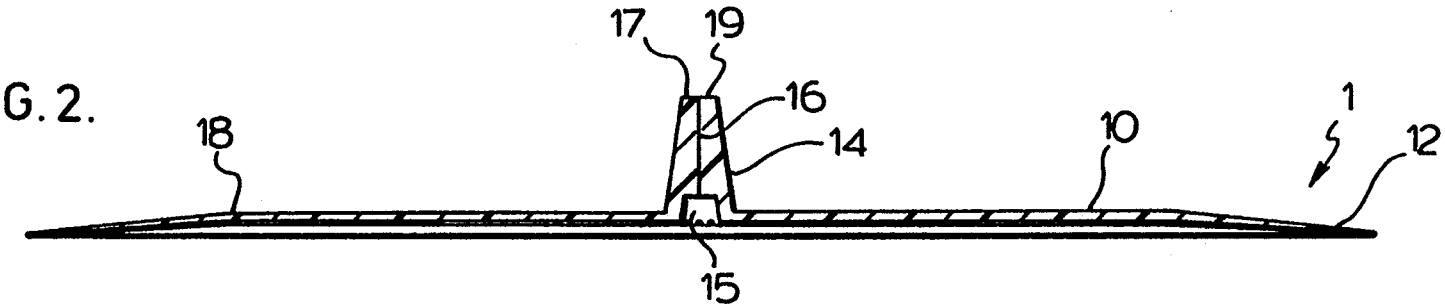
FIG. 2 is a sectional view of the embodiment of FIG. 1 along the lines 2—2.

As shown in FIGS. 1 and 2, the sealing device 1 of the present invention, comprises a generally disc-like member having a rigid central portion 10 with integrally formed flexible perimeter 12. Also formed integrally with the disc is handle 14 and purge valve 16.

Figure 7:
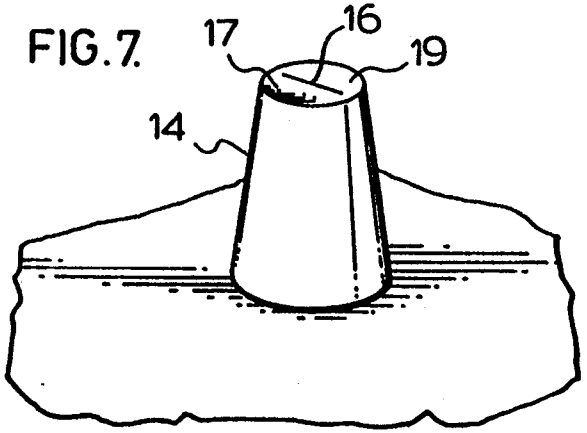
FIG. 7 is a perspective view of the handle of the embodiment of FIG. 1 with the valve in a closed condition.
Figure 8:
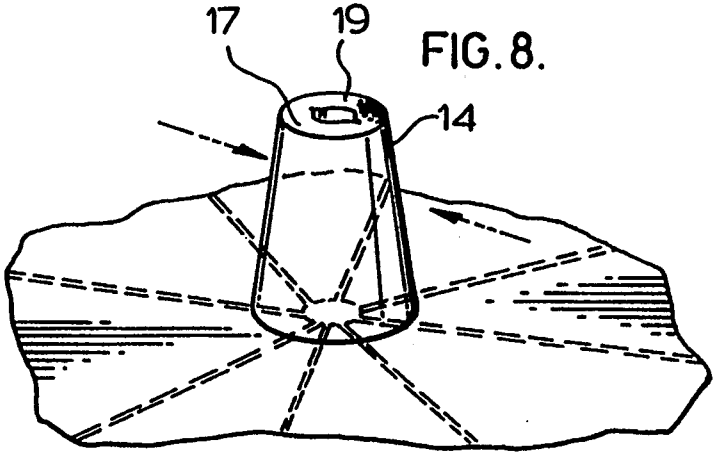
FIG. 8 is a perspective view of the handle of the embodiment of FIG. 1 with the valve in an open condition.

Referring to FIGS. 7 and 8, handle 14 is centrally located and extends upwardly. Handle 14 has a central internal channel 15. At the upper end of channel 15 is purge valve 16. Purge valve 16 is formed by opposed lip formations 17 and 19 which are biased in a closed position forming a substantially air tight seal. The valve 16 will permit air to pass upwardly through the channel 15. However, when handle 14 is pinched or squeezed, an open passage is formed allowing air to freely pass in either direction.

Perimeter 12 of the device is flexible. As shown particularly in FIG. 2 the flexibility of the perimeter 12 is facilitated by a thinning of the material. Such thinning of the material can take the form of a sharp transition point 18 between the rigid portion 10 and the perimeter 12. Alternatively, a gradual thinning of the material from the vicinity of the handle to the edge of the perimeter 20 will also produce satisfactory results.

Figure 3:
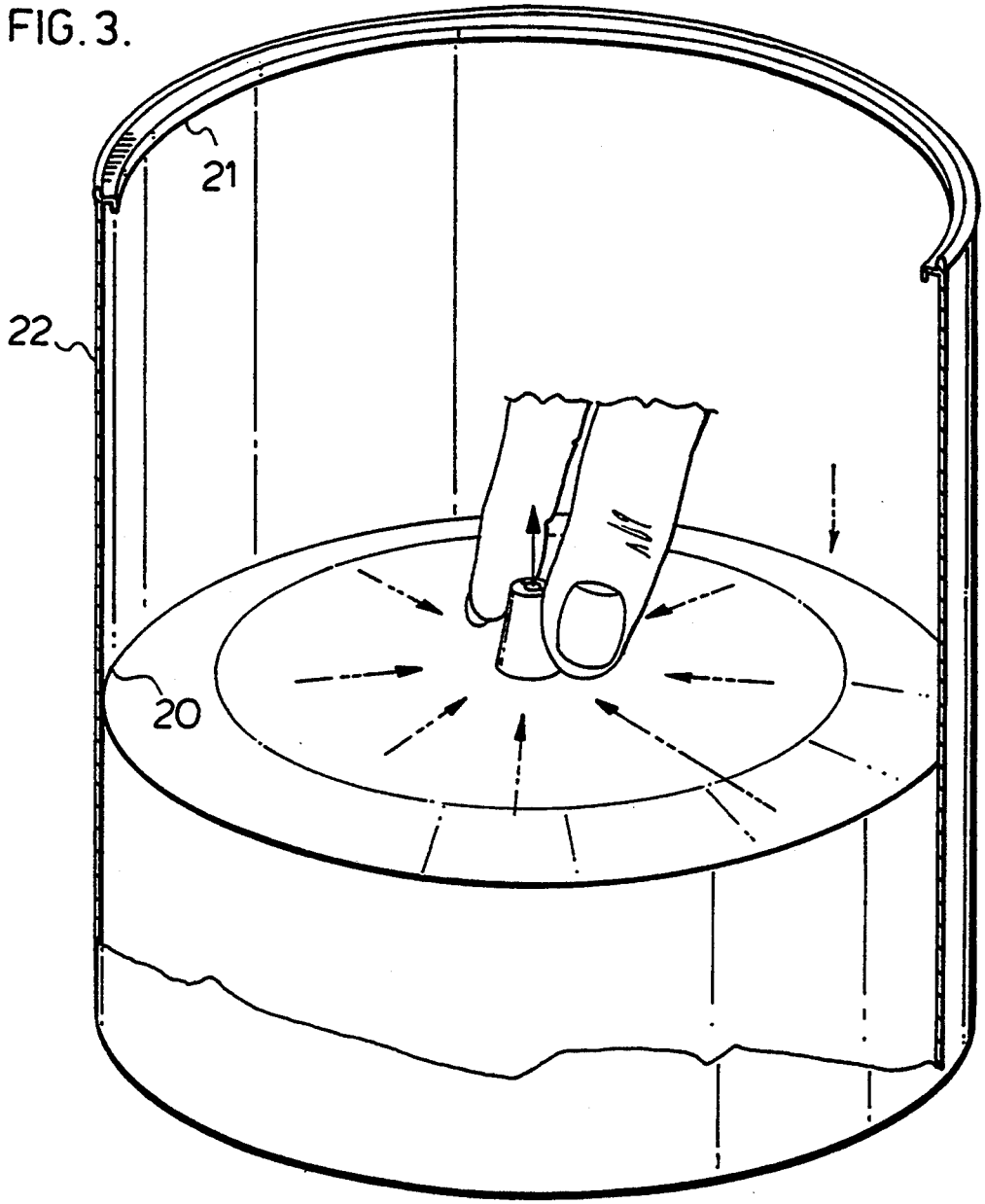
FIG. 3 is a partial sectional view of the embodiment of FIG. 1 being installed in a paint can.
Figure 4:
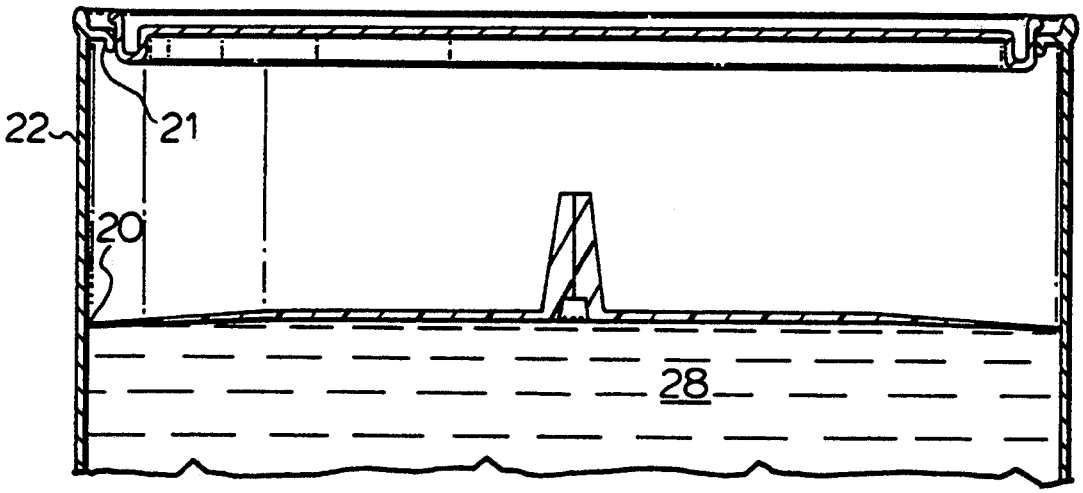
FIG. 4 is a side sectional view of the embodiment of FIG. 1 installed on a paint surface.

As illustrated in FIG. 3 and 4, the sealing device 1 has a diameter equal to or slightly larger than the diameter of the container or paint can 22. As a result the device provides an effective seal along the interior circumference, between edge 20 and the internal wall of the container or paint can 22.

The purge valve 16 is located within the handle 14. When pinched, purge valve 16 permits a flow of air from the lower surface of the device 26 through the handle 14.

Figure 5:
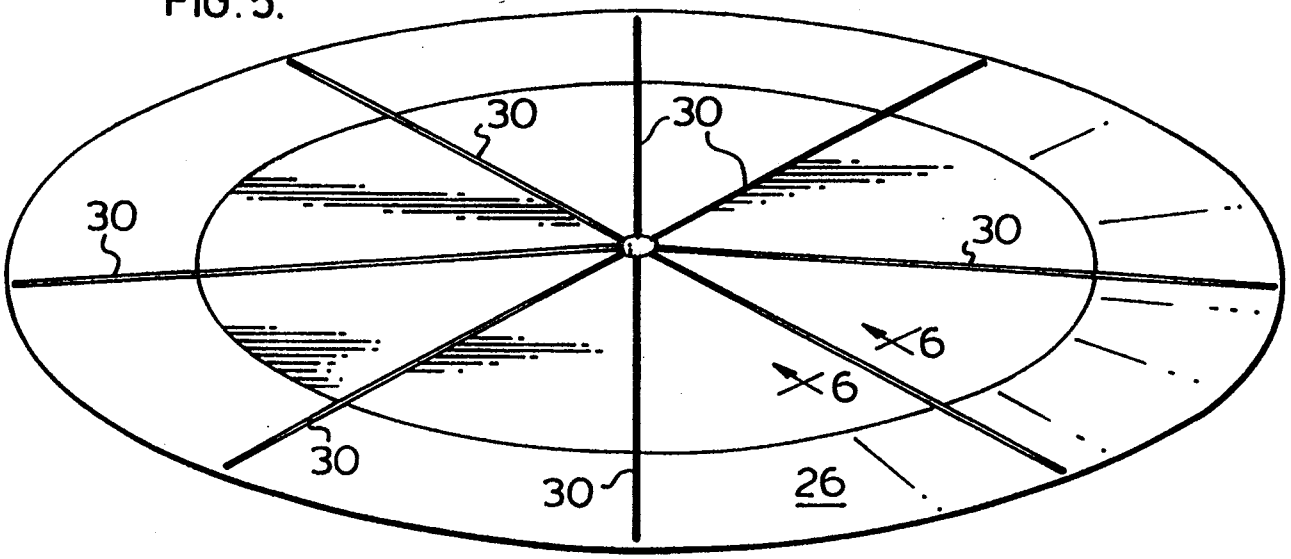
FIG. 5 is a perspective view of the bottom surface of the embodiment of FIG. 1.
Figure 6:
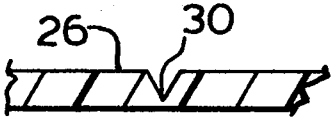
FIG. 6 is a sectional view of the embodiment of FIG. 1 along the lines 6—6 in FIG. 5.

In a preferred embodiment of the invention, the lower surface of the device 26 contains a series of radial channels or indentations 30 extending from near the edge 20 to the entry of the purge valve 16. (see FIG. 5)

In use, the device 1 is inserted into the container or paint can. The flexibility of the perimeter portion of the device permits entry of the device 1 over the lip 21 of the container or paint can 22. The device 1 is urged downwardly towards the surface 28 of the paint. The channels 30 direct the flow of air from beneath the device towards the purge valve 16, as illustrated in FIG. 3.

By only allowing flow of air, the purge valve 16 allows the air trapped between the lower surface 26 and the surface of the contents 28 to escape until the device 1 is in substantial contact with the contents.

To remove the device 1 from contact with the contents, handle 14 is squeezed creating an open passage from the atmosphere to between the device 1 and surface of the contents 28. Handle 14 is lifted upwardly allowing air to pass permitting device 1 to be freely removed from the surface of the contents 28 without creating a suction effect.

The simple and unitary structure of the device allows a simple mode of construction, preferably by injection molding. The choice of a material for construction should be of the type which is non-reactive with paint or the contents being stored in the container, as will be readily apparent to a person skilled in the art. However, nylon 6, 612 or 6—6 is a suitable material for use with most household paints. Suitable nylon materials are available under the trademarks ZYTEL and HYTREL, both available from Du Pont Co.

The device of the preferred embodiment can be molded from a single injection molding process. The flowable nylon material is injected into the mold at the top of the handle 14. The thickness of the wall of handle 14 becomes important depending upon the type of material which is injected to form the device 1. Certain materials, after curing will be stiffer than other materials making squeezing of the handle 14 difficult and sometimes impossible. Accordingly, the thickness of the wall of handle 14 should be minimized to permit squeezability of the handle to open the purge valve 16.

Figure 9:
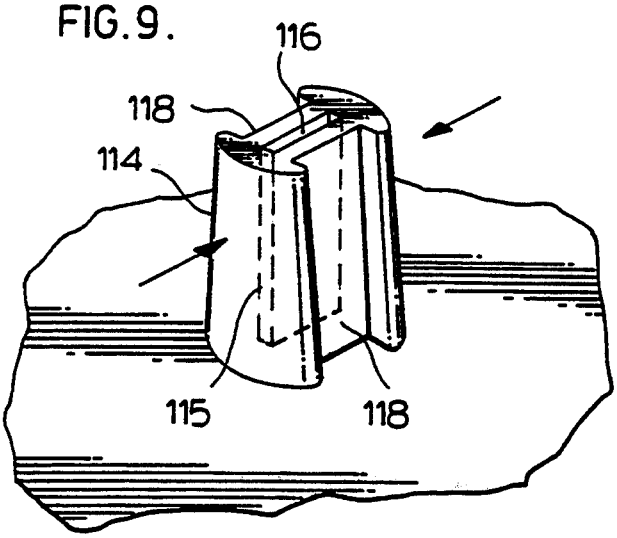
FIG. 9 is perspective view of a second embodiment of the valve stem of the present invention.

Referring to FIG. 9, a second embodiment of the purge valve is disclosed. The handle 114 has an H-shape cross-section to minimize the thickness of the walls 118 maintaining the flexibility thereof. Opening 116 is molded directly to cavity 115. The width of opening 116 which is formed in the mold should be approximately the same size as the shrinkage of the molded material such that after the molded part is ejected from the mold and is allowed to cool, the part will shrink to substantially close the opening 116.

When removing the device 1 from the paint can, the handle 114 is squeezed as indicated by the arrows allowing air to pass therethrough.

Figure 10:
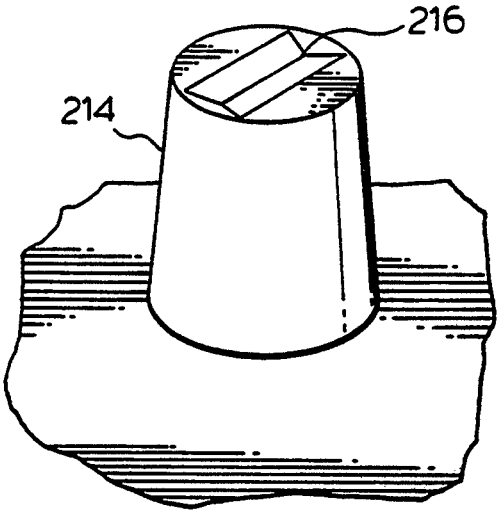
FIG. 10 is a perspective view of a third embodiment of the valve stem of the present invention.
Figure 11:
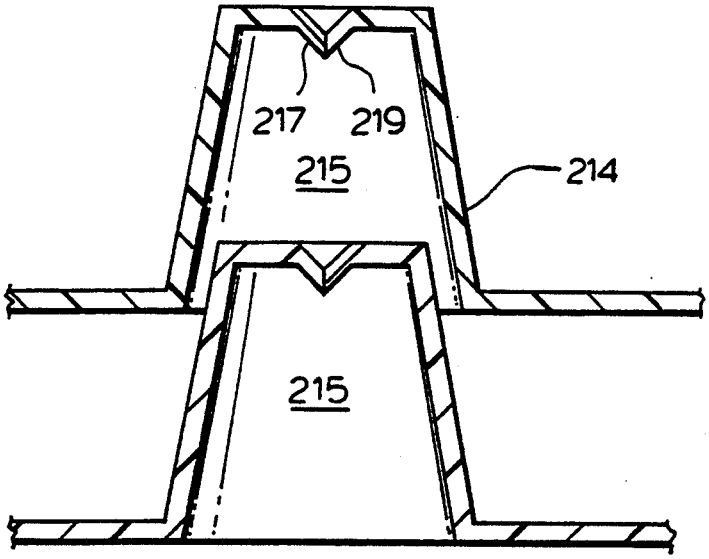
FIG. 11 is a sectional view of the valve stem of the embodiment of FIG. 10 illustrating the device in a stacked relation.

Referring to FIGS. 10 and 11, a third embodiment of the purge valve is disclosed. Purge valve 214 is frusto-conical in shape. The upper surface has a central portion which is thinned along a portion of a diameter as illustrated in FIG. 11. A V-shaped groove is formed which is directed downwardly. A cutting tool is used to sever along the diameter to form opposed lip formations 217 and 219.

Lip formations are normally in a closed condition but will permit air to pass in a downward direction. The device 1 is installed in a manner as described above. To remove the device 1 from a paint can, the user pulls on handle 214. Valve 216 is biased to allow air to pass in a downward direction minimizing the suction effect allowing the device to be removed from the surface of the paint.

In FIG. 11, the channel 215 is enlarged to receive a like handle permitting like devices 1 to be stacked or nested. A large number of like devices may be packaged and stored in an efficient manner using a minimum of space.

Figure 12:
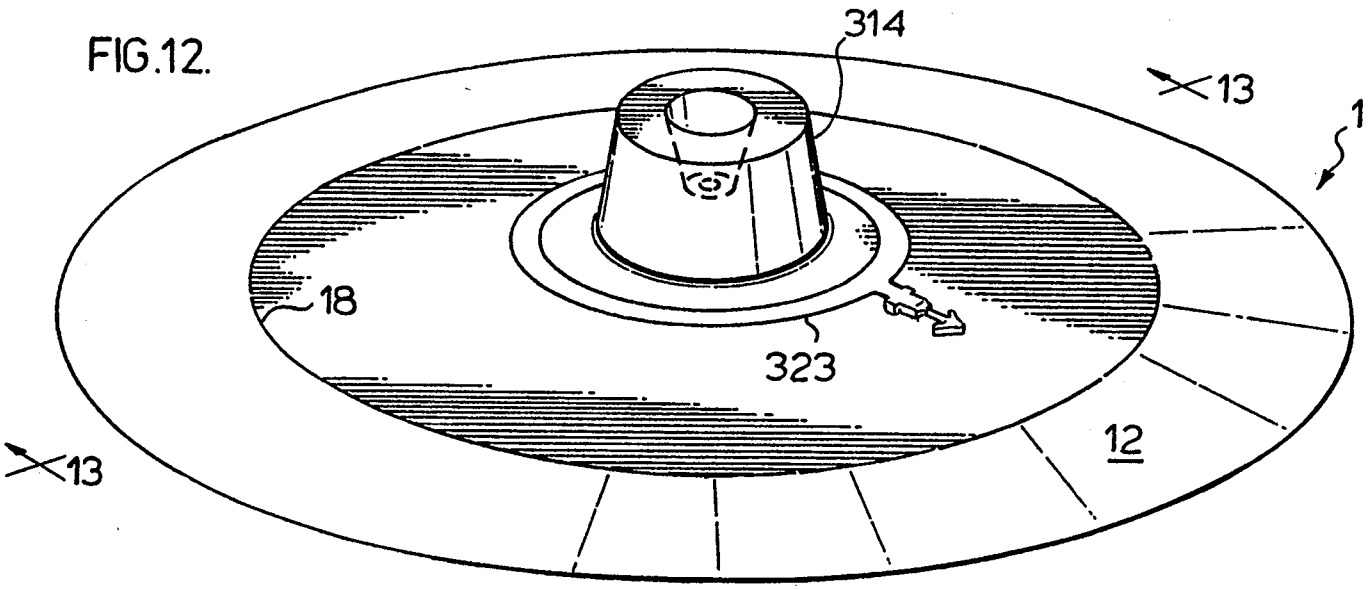
FIG. 12 is a perspective view of the top of the fourth embodiment of the invention.

In FIG. 12, a fourth embodiment is illustrated. The device is identical to the device illustrated in FIG. 1 with the exception of the valve. In this embodiment, the valve 316 is an open circular aperture at the base of a circular recess 321 within handle 314.

Figure 13:
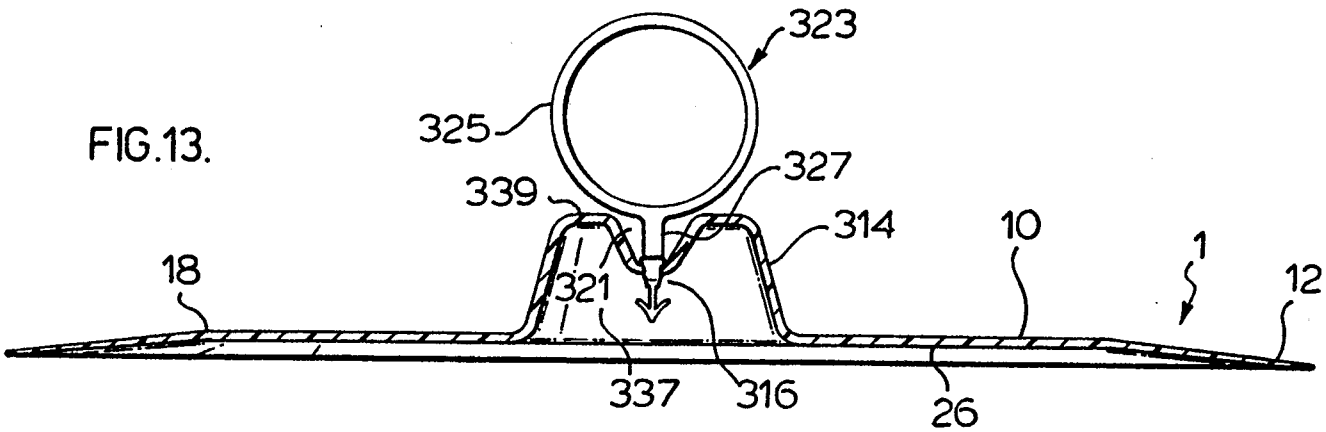
FIG. 13 is a sectional view of the embodiment of FIG. 1 along the lines 13—13.

Referring to FIG. 13, stopper 323 is presented to valve 316 to open and close the vane 316. Stopper 323 has a pull ring 325 which is generally a ring shape. Preferably, the diameter of pull ring 325 is greater than the diameter of the base of the handle 314. The stopper 323 is thus able to be nested over the handle 314 for convenient storage during packaging and shipping.

Figure 14:
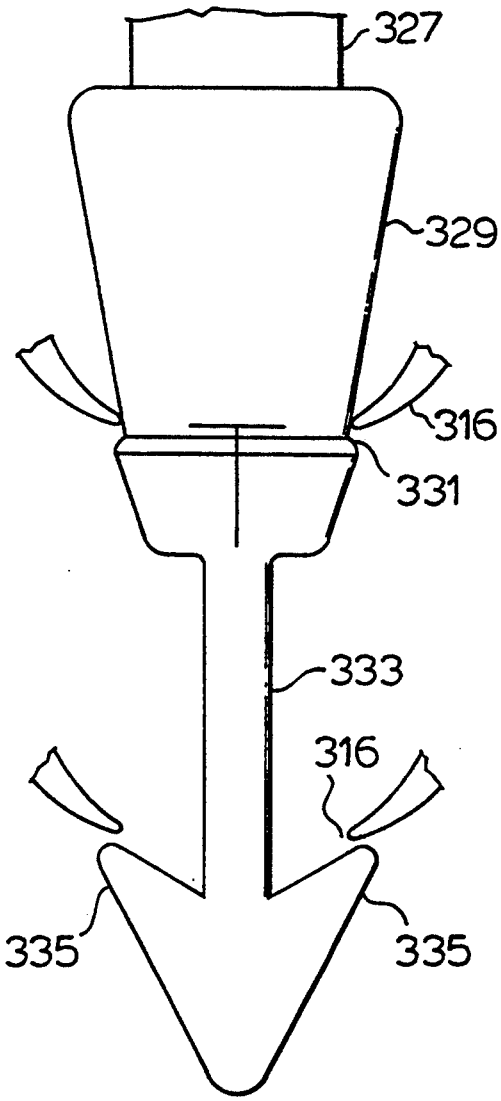
FIG. 14 is a partial front elevational view of the handle of the embodiment of FIG. 12.
Figure 15:
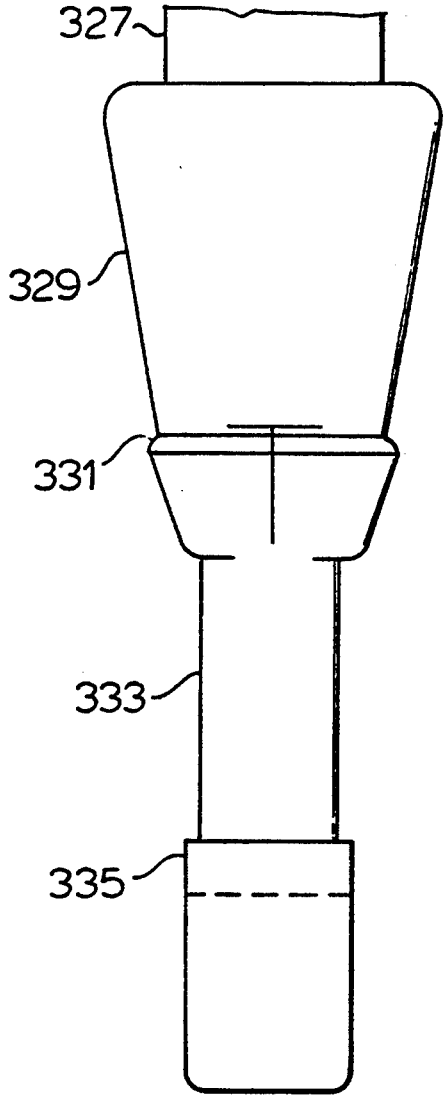
FIG. 15 is a partial side elevational view of the handle of the embodiment of FIG. 12.

Referring to FIGS. 14 and 15, the stopper 323 has a stem 327 adapted to be inserted through valve aperture 316. Stem 327 has a seal region 329 having a frusto-conical shape. Seal region 329 has a lip formation 331 extending about the lower end thereof. Region 329 is sized to sealingly fit within valve aperture 316 to close the valve. Lip 331 is sized to retain the ring handle 323 within valve aperture 316 in a snap fit. Extending from region 329 is extension 333 having at a remote end a pair of tabs 335 presenting an arrow head like structure. The tabs 335 are biased to permit insertion of the stopper 323 into the vane aperture but prevents its removal. The tabs 335 are sized to abut the edge of aperture valve 316 to prevent the removal of the stopper 323. However, the width of the tabs 335 are less than the diameter of the aperture valve 316 to present openings 341.

For packaging, the stopper 323 is placed over the handle 314 and releasably fastened to portion 10, as illustrated in FIG. 12. The stopper 323 could be bonded using a weak frangible glue, taped or shrink-wrapped to the disc. Once the paint sealer is required, the user breaks the stopper 323 from the disc and inserts it into valve aperture 316. The stopper is urged into the valve aperture 316 until tabs 335 have passed the edge of the valve aperture locking the stopper to the disc. The user further inserts the stopper until the edge of valve aperture 316 snappingly fits above the lip formation 331, closing the valve aperture 316.

In use, the device 1 is inserted into the container or paint can. The flexibility of the perimeter portion of the device permits entry of the device 1 over the lip 21 of the container or paint can 22. The device 1 is urged downwardly towards the surface 28 of the paint. Since valve aperture 316 is closed, the air trapped between the disc and the surface of the paint is forced outwardly towards the perimeter edge 12. The air trapped between the lower surface 26 and the surface of the contents will escape until the device 1 is in substantial contact with the contents.

A small amount of air will remain in cavity 337. The amount of air will not be adequate to react with the contents. However, the air increases the buoyancy of the device on the content surface.

To remove the device 1 from contact with the contents, stopper 323 is pulled upwardly by pulling on pull ring 325 until lip formation 331 is urged past the aperture valve 316. If two hands are required to open the valve, the user's other hand may be placed on the top surface 339 of handle 314. Tabs 335 will prevent the stopper 323 from being fully removed.

Figure 16:
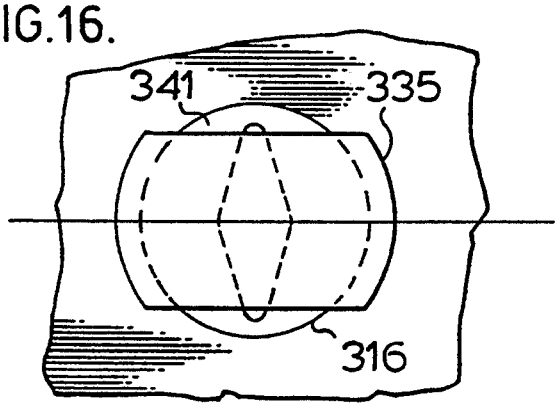
FIG. 16 is a partial bottom view of the handle inserted through the aperture of the embodiment of FIG. 12.

As illustrated in FIG. 16, the tabs 335 are shaped to not fully close aperture valve 323 leaving openings 341. Openings 341 permit air to pass through valve 316 as the user pulls upwardly on the stopper removing the disc 1 from the surface of the contents 28 without creating a suction effect. The disc may cleaned for storage or re-use in a different paint can.

Preferably, the stopper 323 is made from the same nylon material as the disc. The stopper may be also manufactured using an injection molding process.

It is to be understood that the scope of the present invention is not to be limited to the specific embodiments described above. The invention may be practiced other than as particularly described and still be within the scope of the accompanying claims.

I claim:

1. A sealing device for sealing a container having a bottom, an interior plan and a closable top, and said container fillable with a liquid content to present an upper surface, said device comprising:

a disc-like member integrally having a central portion, a flexible perimeter and a centrally located upstanding hollow handle, said hollow handle having a purge valve, said purge valve having a closed position for preventing egress of air through said hollow handle and an open position to permit free passage of air therethrough, said disc-like member is contoured to correspond with said interior plan of said container, said purge valve comprising:

an aperture in the handle, a stopper for slideably inserting through the aperture for moving said purge valve between the open position and the closed position said stopper having a stem portion having a frusto-conical seal region for sealingly engaging said aperture when said purge valve is in said closed condition, a tab formation at a first end of said stem, said tab formation biased to permit insertion of said stopper into said aperture and to retain the stopper therein, said tab formation sized to partially close said aperture when said valve is in said open position, and a gripping means opposite said first end, said gripping means for gripping said stopper to facilitate pulling of said stopper moving the purge valve from the closed position to the open position, urging the tab formation against the handle for removing said device from contact with said upper surface.

2. A device as claimed in claim 1 wherein said stopper has a gripping means for gripping said stopper to facilitate pulling of said stopper moving the purge valve from the closed position to the open position.

3. A device as claimed in claim 2 wherein said gripping means is a pull ring.

4. A device as claimed in claim 3 wherein said pull ring is sized to be placed about said handle and said handle has an interior which is contoured to receive a like handle for storing like devices in a nested condition when said pull ring is placed about said handle.

5. A device as claimed in claim 4 wherein said device is contoured to fit within a paint can.

6. A device as claimed in claim 5 wherein said device is made from a nylon material and injection molded.

7. A sealing device for sealing a container having a bottom, an interior plan and a closable top, and said container fillable with a liquid content to present an upper surface, said device comprising:

a disc-like member having a central portion and a flexible perimeter and having a centrally located upstanding hollow handle having a purge valve, said purge valve having a closed position on for preventing egress of air through said hollow handle and an open position to permit free passage of air therethrough, said disc-like member is contoured to correspond with said interior plan of said container, said purge valve comprising:

an aperture in the handle, a stopper for slideably inserting through aperture for moving said purge valve between the open position and the closed position, said stopper having a stem portion having a seal region for sealingly engaging said aperture when said purge valve is in said closed condition, said stem portion having a lip formation for engaging said aperture in a snap fit releasably retaining the seal region in sealing engagement with the aperture.

a tab formation at a first end of said stem, said tab formation biased to permit insertion of said stopper into said aperture and to retain the stopper therein, said tab formation sized to partially close said aperture when said valve is in said open position.

* * * * *